US005321198A

United States Patent [19]

Suzuki et al.

[11] Patent Number: 5,321,198

[45] Date of Patent: Jun. 14, 1994

[54] TONE SIGNAL GENERATOR UTILIZING ANCILLARY MEMORIES FOR ELECTRONIC MUSICAL INSTRUMENT

[75] Inventors: Hideo Suzuki; Yoshio Fujita, both of Hamamatsu, Japan

[73] Assignee: Yamaha Corporation, Hamamatsu, Japan

[21] Appl. No.: 938,435

[22] Filed: Aug. 31, 1992

[30] Foreign Application Priority Data

Sep. 5, 1991 [JP] Japan ..... 3-254698

[51] Int. Cl.[5] ..... G10H 1/18; G10H 7/00

[52] U.S. Cl. ..... 84/605; 84/615

[58] Field of Search ..... 84/604-607, 84/615-620

[56] References Cited

U.S. PATENT DOCUMENTS 5,054,358 10/1991 Usami ..... 84/615 X

FOREIGN PATENT DOCUMENTS 51-130211 11/1976 Japan .

*Primary Examiner*—Stanley J. Witkowski

*Attorney, Agent, or Firm*—Graham & James

[57] ABSTRACT

A tone signal generator utilizing ancillary memories for an electronic musical instrument system has a source memory storing a long and continuous waveform data and two ancillary memories each capacity of which is smaller than that of the source memory. A portion of the continuous waveform data from the source memory is written into one of the ancillary memories. After completion of the writing operation, the written waveform data is read out for tone production, and simultaneously another portion of the continuous waveform data is written into the other of said ancillary memories. The repetition of such operation make it possible to reproduce a long and continuous tone waveform in spite of the small capacity of the ancillary memories.

19 Claims, 10 Drawing Sheets

φ
L1
L2
L0
CH
16
1
2
3
4
5
6
7
8
9
10
11
12
13
14
15
16
1
2
3
EN1
EN2
EN3
EN4
SEL
IRQE
L
R
L
R
L
R
PLAY BACK
TRANSFER
READ OUT
READ OUT

TONE SIGNAL GENERATOR UTILIZING ANCILLARY MEMORIES FOR ELECTRONIC MUSICAL INSTRUMENT

BACKGROUND OF THE INVENTION

1. Field of the Invention

The present invention relates to a tone signal generator utilizing ancillary memories for an electronic musical instrument system reading out waveform data from the ancillary memories to generate a tone signal based on the read out waveform data. More particularly, the present invention relates to a tone signal generator utilizing the ancillary memories as a double buffer memory in order to generate a sound signal recorded in the natural world, a sound signal electronically synthesized, etc. as a continuous tone signal for a long period of time.

2. Description of the Prior Art

In Japanese Patent Application Laid-Open No. Sho51-130211, there is disclosed a tone signal generator for an electronic musical instrument having a source memory for beforehand storing several sets of waveform data which represent a cycle of waveform respectively, first and second read/write memories for storing waveform data which represent a half cycle of waveform and an address counter for designating addresses of both the read/write memories, wherein under address designation of the address counter each waveform data stored in the source memory are written into the read/write memories every predetermined time interval and the written waveform data are repeatedly and alternately read out from the read/write memories in order to generate a tone signal. The tone signal generator further comprises a calculation circuit for modifying the waveform data stored in the read/write memories, the modified waveform data are also written into the read/write memories under address designation of the address counter. In the tone signal generator, however, writing and reading operations are controlled synchronously by the single address counter. This results in the difficulty of designing a writing operation portion and a reading operation portion independently. Additionally, in the tone signal generator, a source memory does not store a continuous waveform data for a long period of time. As a result, a generated tone signal becomes monotonous.

SUMMARY OF THE INVENTION

Accordingly, it is an object of the present invention to provide a tone signal generator utilizing ancillary memories for an electronic musical instrument system improved for generating a continuous waveform signal for a long period of time.

It is another object of the present invention to provide a tone signal generator utilizing ancillary memories for an electronic musical instrument system capable of easily installing a memory of large capacity such as a hard disk memory in an electronic musical instrument system.

It is another object of the present invention to provide a tone signal generator utilizing ancillary memories for an electronic musical instrument system capable of generating a long and continuous sound signal in a natural world such as a sound of wind, a sound of flowing water, a sound of rain, a sound of wave on beach, etc. as a back-ground music for a performance tone.

According to the present invention, a tone signal generator utilizing ancillary memories for an electronic musical instrument system comprises a source memory for storing a continuous waveform data to be applied to the electronic musical instrument system for a long period of time, a set of ancillary memories each capacity of which is smaller than that of the source memory, writing means for alternately writing the continuous waveform data from the source memory into the ancillary memories at a predetermined time interval, reading means for alternately reading out the written waveform data from the source memory and control means for controlling the reading means in such a manner that the written waveform data is read out at a higher rate than the writing rate of the waveform data.

In a preferred embodiment of the present invention, the control means includes means for adjusting reading rate independently defined from the writing rate.

In another preferred embodiment of the present invention, the source memory is a hard disk memory.

In another preferred embodiment of the present invention, the ancillary memories are two regions formed in a random access memories.

In another preferred embodiment of the present invention, the writing means and the reading means have address designation means respectively for independently designating addresses of the ancillary memories.

In another preferred embodiment of the present invention, the tone signal generator further comprises record means for recording a continuous waveform data in the source memory.

According to another present invention, a tone signal generator utilizing ancillary memories for an electronic musical instrument system has note designation means for designating one of plural notes to produce a note data indicative of the designated note, a plurality of tone channels to be applied with the note data for producing a tone signal of the applied note data and assignment means for assigning the note data to either one of the tone channels, the tone signal generator comprises a source memory for storing a continuous waveform data to be applied to the tone channels for a long period of time and a mode selector for selectively setting a first mode or a second mode, wherein the assignment means includes means responsive to a first signal indicative of the first mode from the mode selector for permitting assignment of the continuous waveform data to at least one of the tone channels for producing a tone signal of the continuous waveform data therefrom and also permitting the assignment of the note data to the remaining tone channels and responsive to a second signal indicative of the second mode from the mode selector for permitting only the assignment of the note data to the tone channels.

According to another present invention, a tone signal generator utilizing ancillary memories for an electronic musical instrument system comprises a source memory for storing waveform data representing a time-variant continuous-waveform having plural periods, the waveform data being composed of plural partial data, a set of ancillary memories each capacity of which is smaller than that of the source memory, writing means for writing at a writing rate sequentially each of said plural partial data from the source memory into an available one of the ancillary memories at a predetermined time interval, the available one alternating among the ancillary memories and reading means for reading out at a reading rate previously-written partial data from one of the ancillary memories except the available one, the reading rate being lower than the writing rate.

According to another present invention, a toner signal generator utilizing ancillary memories for an electronic musical instrument system comprises note designation means for designating one of plural notes to produce note data indicative of the designated note, a plurality of tone channels each producing a tone signal corresponding to data assigned thereto, a source memory for storing waveform data representing a time-variant continuous-waveform having plural periods, a mode selector for selectively setting a first mode or a second mode and assignment means responsive to the select first mode for assigning the waveform data to a specified one of the tone channels and assigning the note data to an available one of the tone channels other than the specified channel, and responsive to the selected second mode for assigning the note data to an available one of the tone channels.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
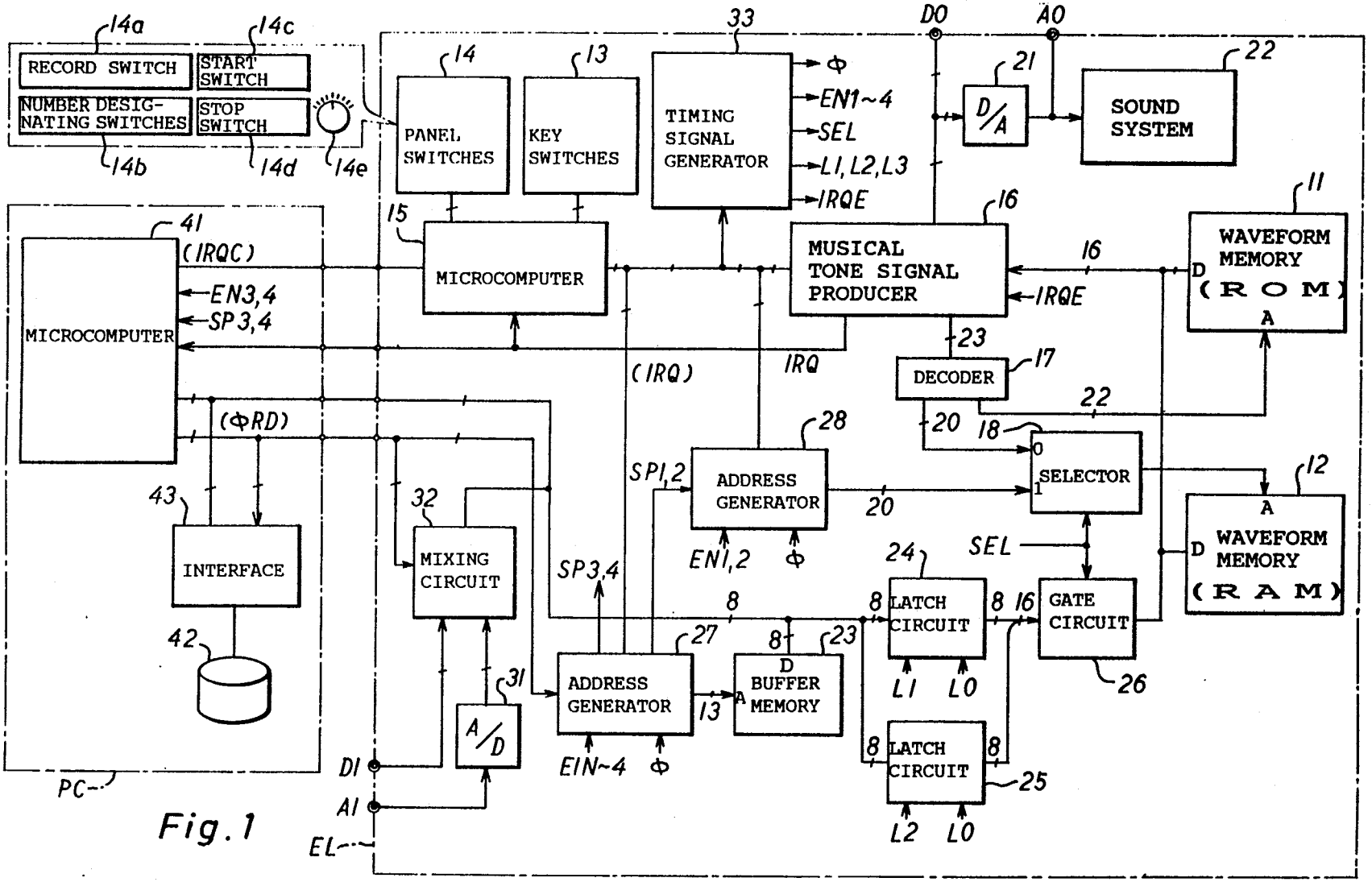
FIG. 1 is a block diagram of an electronic musical instrument system provided with a tone signal generator in accordance with the present invention.

In FIG. 1 of the drawings, there is diagrammatically illustrated an electronic musical instrument system which is provided with an electronic musical instrument EL for generating tone signals and a personal computer system PC for controlling the electronic musical instrument EL. The electronic musical instrument has waveform memories 11, 12 for storing waveform data. The waveform memory 11 is in the form of a read only memory or ROM (for instance, 8 megabyte ROM) which is divided into a plurality of regions in which several kinds of predetermined waveform data are respectively stored. The waveform memory 12 is in the form of a random access memory or RAM (for instance, 2 megabyte RAM) which is also divided into a plurality of regions in which several kinds of waveform data are respectively stored before performance. The waveform data stored in the waveform memories 11, 12 are read out by a microcomputer 15 and a tone signal producer 16 in response to operation of key switches 13 and panel switches 14 for producing tone signals.

Key switches 13 are arranged to be respectively opened and closed by a plurality of keys corresponding to the musical scale note to detect operation of the keys. Panel switches 14 include a record switch **14*a*, number designating switches 14*b*, a start switch 14*c*, stop switch 14*d*, a volume 14*e*, etc. for designating an operation mode, a tone color, a tone volume, a musical effect, etc. The microcomputer 15 is arranged to execute program represented by flow charts shown in FIGS. 6–11 to control various operation modes of the electronic musical instrument EL. A tone signal producer 16 has 16 time division tone signal producing channels which are designed to apply address signals to the waveform memory 11 through a decoder 17 for reading out the waveform data therefrom and to also apply address signals to the waveform memory 12 through the decoder 17 and a selector 18 for reading out the waveform data therefrom, and to produce digital tone signals having amplitude envelopes and musical effects based on the read out waveform data. The selector 18 is controlled by a select signal SEL (see FIG. 12) applied from a timing signal generator 33 to output an address signal applied from the decoder 17 when the select signal SEL is high level "1" and to output an address signal applied from an address generator 28 when the select signal SEL is low level "0". The tone signal producer 16 is designed to distributes the digital tone signals to left and right channels of a sound system 22 through a D/A converter 21. D/A converter 21 converts digital tone signals into analogue tone signals. The sound system 22 has a pair of amplifiers and speakers for the left and right channels to respectively sound musical tones corresponding to the analogue tone signals applied thereto. Arranged at the input side of D/A converter 21 is a digital output terminal DO which outputs the digital tone signals applied from the tone signal producer 16 to outside. Arranged at the output side of D/A converter 21 is an analogue output terminal AO which outputs the analogue tone signals converted by the D/A converter 21** to outside.

Figure 2:
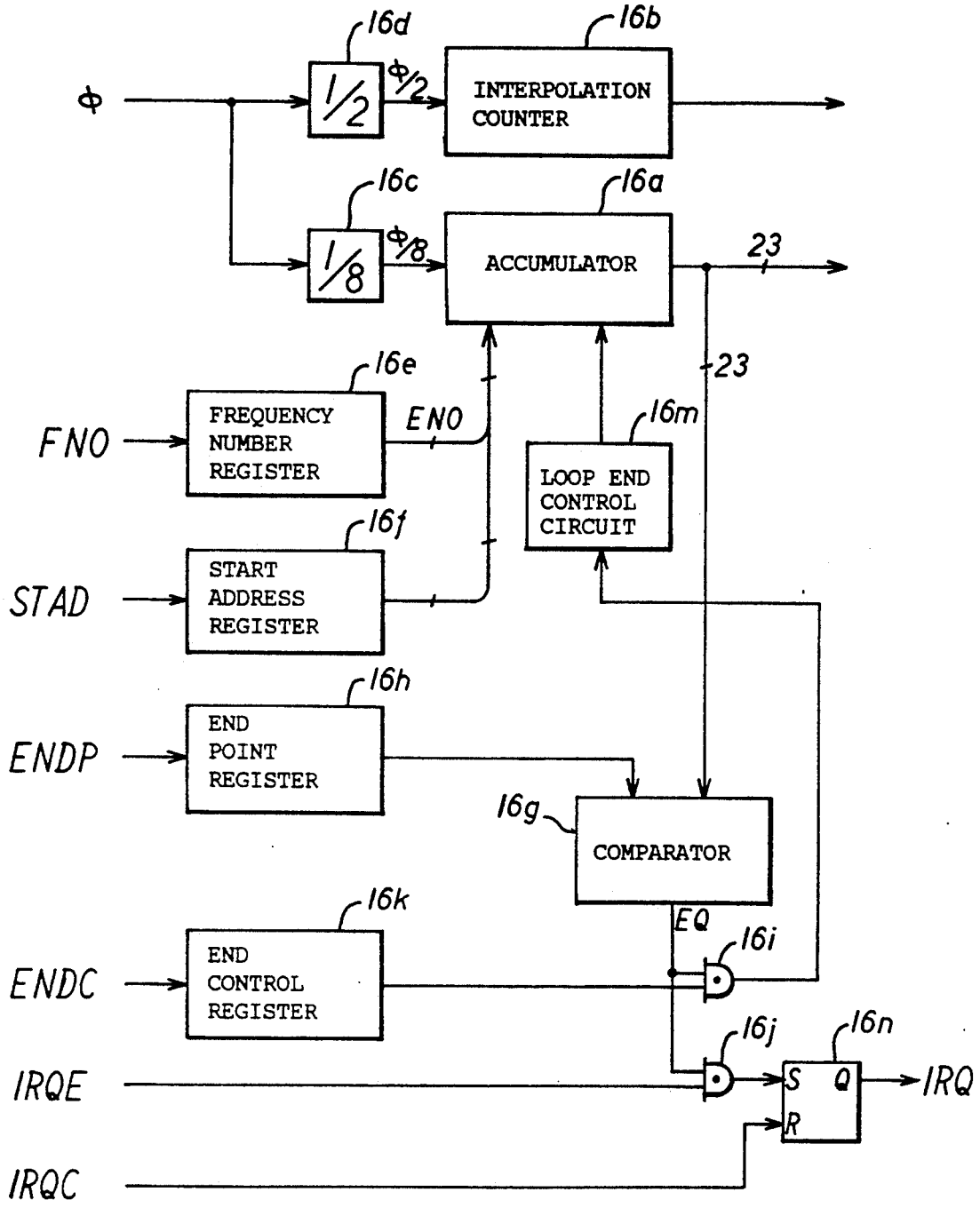
FIG. 2 is a block diagram of a tone signal producer shown in FIG. 1.

The tone signal producer 16 has a circuit which applies an interruption signal IRQ to the personal computer system PC and a microcomputer 15 to determine the timing at which the personal computer system PC transfers a part of long and continuous waveform data representing a long and continuous waveform signal to the waveform memory 12. This circuit is shown in FIG. 2 with an accumulator **16*a* and an interpolation counter 16*b* for controlling reading out the waveform data from the waveform memories 11, 12. The accumulator 16*a* is designed to form address signals composed of several bits (for instance, 23 bits) based on frequency number data FNO applied from a frequency number register 16*e* and start address data STAD (see FIG. 13) applied from a start address register 16*f* at divided time corresponding to the time division tone signal producing channels, the frequency number FNO determines changing rate of the address signals, the start address data STAD determines initial values of the address signals. The frequency number register 16*e* memorizes the frequency number data FNO applied from the microcomputer 15 in the time division manner, the frequency number data FNO relate to the tone pitch designated by a depressed key. The start address register 16*f* also memorizes the start address data STAD applied from the microcomputer 15 in the time division manner, the start address data STAD relate to a tone color selected by the panel switches 14. The accumulator 16*a* also receives a clock signal from a ⅛-divider 16c which divide the system clock signal $\phi$ (see FIG. 12) by 8, the system clock signal $\phi$ is applied from a timing signal generator 33. The interpolation counter 16b is designed to count a clock signal $\phi/2$ from a ½-divider 16d which divides the system clock $\phi$ by 2. Therefore, the interpolation counter 16b counts up 4 times faster than the accumulator 16b to interpolate four sets of waveform data read out from the waveform memories 11, 12 by the accumulator 16b**.

A comparator 16g has a first input terminal connected to the output terminal of accumulator 16a and the second input terminal connected to an output terminal of end point register 16h to apply an equal signal EQ to an AND circuits 16i, 16j when the values indicated by both input signals are equal. The end point register 16h is designed to memorize the end address data $ENDP_2$ (see FIG. 13) for determining end value of the address signals outputted from the accumulator 16a in the time division manner in case usual waveform data stored in the memories 11, 12 are repeatedly read out to produce usual waveform signals, and to memorize the end address data $ENDP_2$ and the middle address data $ENDP_1$ (see FIG. 13) representing the middle value between the start address data value STAD and the end address data value $ENDP_2$ in the time division manner in case long and continuous waveform data are read out therefrom to produce long and continuous waveform signals. Connected to an input terminal of AND circuit 16i is an end control register 16k which memorizes an end control data ENDC in a time division manner. The end control data ENDC is constantly maintained to high level "1" at time division channels which produce usual waveform signals, and is maintained to low level "0" at time division channels which produce the second half $B_0$, $B_1$, $B_2$ . . . (see FIG. 13) of each block of the long and continuous waveform data. The output terminal of AND circuit 16i is connected to a loop end control circuit 16m which sets the address data memorized in the time division channels of the accumulator 16a to the start address data value STAD memorized in the start address register 16f in response to the output of the AND circuit 16i. The AND circuit 16j is arranged to be applied with a interruption enable signal IRQ (see FIG. 12) from the timing signal generator 33 and to apply an output signal to a set input terminal S of flipflop circuit 16n. The flipflop circuit 16n inputs an interruption clear signal IRQC at its reset input terminal R from the personal computer system PC through the microcomputer 15 and outputs an interruption signal IRQ at an output terminal Q.

Figure 3:
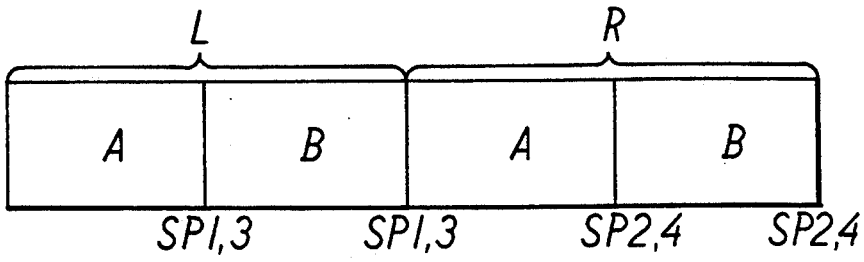
FIG. 3 is a memory map of a buffer memory and a memory region of a waveform memory for storing continuous waveform data shown in FIG. 1.

The personal computer system PC is designed to write the long and continuous waveform data representing a long and continuous waveform signal in the waveform memory 12 via a buffer memory 23 which is in the form of RAM (for instance, 8 kilobyte RAM). Between the buffer memory 23 and the waveform memory 12, latch circuits 24, 25 and a gate circuit 26 are interposed. Latch circuits 24, 25 are controlled by the latch control signals L0–L2 (see FIG. 12) applied from the timing signal generator 33 to convert 8 bit waveform data to 16 bit waveform data. The gate circuit 26 are controlled by a select signal SEL (see FIG. 12) applied from the timing signal generator 33 to apply the converted waveform data to the waveform memory 12 while the select signal SEL is high level "1". As shown in FIG. 3, the buffer memory 23 is divided into left and right channel regions L, R which are respectively subdivided into the first and the second halves A, B. Each address of buffer memory 23 is designated every 16 bits (corresponding to 2 bytes) by an address generator 27. The waveform memory 12 has a memory area for storing the long and continuous waveform data applied from the personal computer system PC via the buffer memory 23. The memory area is also divided into left and right channel regions L, R which are respectively subdivided into first and second halves A, B. Each address of this memory area is designated every 8 bits (corresponding to 1 byte) by an address generator 28.

Figure 4:
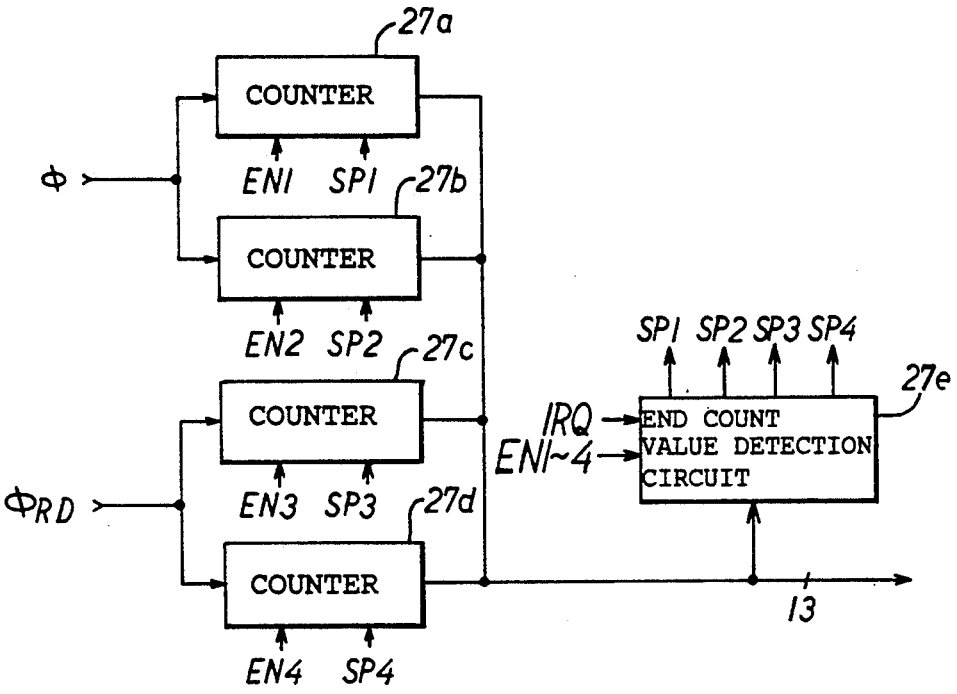
FIG. 4 is a block diagram of an address generator shown in FIG. 1.

As shown in FIG. 4, the address generator 27 has four counters 27a–27d. The counter 27a counts the system clock signal $\phi$ applied from the timing signal generator 33 to designate the addresses of the left channel region L of buffer memory 23 for reading out the data therefrom. The counter 27b also counts the system clock signal $\phi$ to designate the addresses of the right channel region R of buffer memory 23 for reading out the data therefrom. The counter 27c counts a clock signal $\phi_{RD}$ applied from the personal computer system PC to designate the addresses of the left channel region L of buffer memory 23 for writing the data therein. The counter 27d counts the clock signal $\phi_{RD}$ to designate the addresses of the right channel region R of buffer memory 23 for writing the data therein. These counters 27a–27d are respectively enabled to count up when enable signals EN1–EN4 (see FIG. 12) applied from the timing signal generator 33 are respectively high level "1", and are respectively disabled when stop signals SP1–SP4 applied from an end count value detection circuit 27e are respectively high level "1". Accordingly, the counters 27a–27d do not count up simultaneously. Additionally, the enable signals EN1–EN2 synchronize with the system clock signal $\phi$, and change from high level "1" to low level "0" just after the counters 27a–27d finish designating the address for the lower byte of each word of the long and continuous waveform data because of each word is composed of 2 bytes or 16 bits. The output terminals of the counters 27a–27d are connected to the end count value detection circuit 27e. The end count value detection circuit 27e detects the middle and end count values corresponding to the middle and end address values $ENDP_1$, $ENDP_2$ of the left and right channel regions L, R of buffer memory 23 under the control of the enable signals EN1–EN4 to respectively change the stop signals SP1–SP4 from low level "0" to high level "1", and respectively maintains the stop signals SP1–SP4 to high level "1" until they are cleared by the interruption signal IRQ applied from the tone signal producer 16 through the microcomputer 15.

Figure 5:
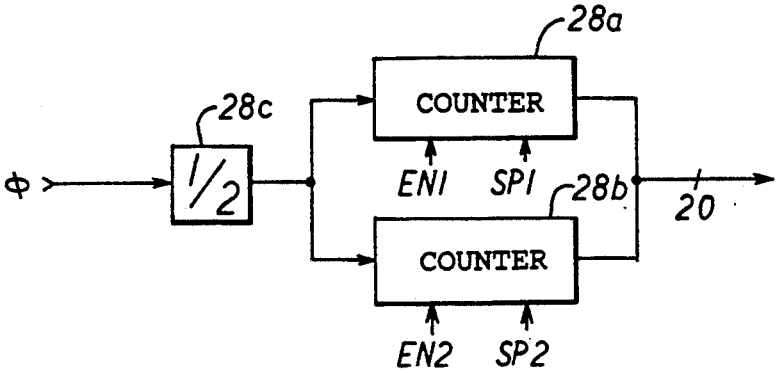
FIG. 5 is a block diagram of another address generator shown in FIG. 1.

As shown in FIG. 5, the address generator 28 has a divider 28c which divides the system clock signal $\phi$ by 2 to apply a clock signal $\phi/2$ to the counters 28a, 28b. The counters 28a, 28b respectively count the clock signal $\phi/2$ to designate the addresses of left and right channel regions L, R of waveform memory 12 for writing the long and continuous waveform data therein. These counters 28a, 28b are respectively enabled to count up when enable signals EN1, EN2 applied from the timing signal generator 33 are respectively high level "1" (see FIG. 12), and are respectively disabled when stop signals SP1, SP2 applied from the end count value detection circuit 27e are respectively high level "1". Accordingly, the counters 28a, 28b do not count up simultaneously.

The electronic musical instrument EL has an analogue input terminal AI for an analogue input signal and a digital input terminal DI for a digital input signal which inputs external sound signals for left and right channels applied from the other musical instruments, microphones, etc. The analogue input terminal AI is connected to a mixing circuit 32 through an A/D converter 31 which converts an analogue signal into a digital signal. The digital input terminal DI is directly connected to the mixing circuit 32. The mixing circuit 32 mixes the signals applied from the A/D converter 31 and applied from the digital input terminal DI to apply the mixed signals to the personal computer system PC.

The personal computer system PC has a microcomputer 41 and a hard disk memory 42 as a memory of large capacity. The microcomputer 41 cooperate with microcomputer 15 by executing a program (not shown) to write a long and continuous waveform data applied from the electronic music instrument EL into the hard disk 42 through an interface circuit 43 for a long period of time and to read out the long and continuous waveform data from the hard disk 42 to the electronic musical instrument EL through the interface circuit 43. The long and continuous waveform data are representing a time-variant continuous-waveform having plural periods.

Hereinafter, the operation of the electronic musical instrument system will be described. When the power source switch (not shown) is closed, the microcomputer 15 is activated to initiate execution of the main program at step 100 in FIG. 6 and executes initialization routine at 101. In the initialization routine, the microcomputer 15 sets a mode flag MD for representing record mode of the long and continuous waveform signal to "0", and causes the timing signal generator 33 to initiate generating the system clock signal $\phi$ and to maintain the signals L0, L1, L2, EN1–EN4, SEL, IRQ to low level "0". In this initialization routine, several kinds of waveform data representing usual short waveform signals are also written in the left and right channel regions L, R of the waveform memory 12 as a standard data. After executing the initialization routine, the microcomputer 15 repeatedly executes key switch processing routine, panel switch processing routine and other processing routine at steps 103–105. In the other processing of step 105, the usual short waveform data written in the waveform memory 12 may be changed by a player.

When the panel switches 14 are operated for selecting a tone color, tone volume and a musical effect of tone signals before playing keys, the microcomputer 15 applies parameters for determining the tone color, the tone volume and the musical effect of tone signals to the tone signal producer 16. The tone signal producer 15 prepares for producing the tone signal based on the parameters. In this instance, the start address data STAD (see FIG. 13) for designating the addresses of a memory region of waveform memories 11, 12 is commonly memorized in the 16 time division channels of start address register 16*f*, in this memory region the waveform data corresponding to the selected tone color is stored. The end address data $ENDP_2$ (see FIG. 13) for designating the end of the memory region is also memorized in 16 time division channels of the end point register 16*h*. And, the end control data ENDC representing high level "1" is memorized in 16 time division channels of the end control register 16*k*.

When any one of the keys is depressed after above-mentioned preparation, the microcomputer 15 detects the key depression by ON operation of the key switches 13 to assign the depressed key or a designated note corresponding to the depressed key to any one of the 16 time division tone signal producing channels of tone signal producer 16 at step 103. The microcomputer 15 also applies a channel signal indicative of the assigned channel, a frequency number FNO or note data indicative of the tone pitch of the depressed key and a key-on signal indicative of key depression to the tone signal producer 16. The frequency number register 16*e* of tone signal producer 16 memorizes the applied frequency number FNO at its time division channel designated by the applied channel signal. The accumulator 16*a* accumulates the frequency number FNO on the start address data STAD memorized in the start address register 16*f* at the same time division channel as the register 16*e* to apply the accumulation result thereof as an address signal to the decoder 17 for reading out the waveform data. The decoder 17 outputs the address signal to the waveform memory 11 if the address signal designates the waveform memory 11, and outputs the address signal to the waveform memory 12 through the selector 18 if the address signal designates the waveform memory 12. In this instance, the selector 18 applies the inputted address signal to the waveform memory 12, since the select signal SEL applied from the timing signal generator 33 indicates low level "0" because of the mode flag MD maintained to low level "0". Thus, the waveform data is read out from designated one of waveform memories 11, 12 to be applied to the tone signal producer 16. The tone signal producer 16 interpolates the read out four sets of waveform data under the operation of the interpolation counter 16*b* to produce a digital tone signal having an amplitude envelope, a musical effect, etc. at a time division tone signal producing channel. The tone signal producer 16 also respectively sums up the digital tone signals produced in the 16 tone signal producing channels for left and right channels L, R to output the digital tone signals to the D/A converter 21. D/A converter 21 converts the digital tone signals into analogue tone signals and apply the converted tone signals to the sound system 22. Thus, the sound system 22 sounds musical tones corresponding to the analogue tone signals at spaced left and right channels. In this instance, the pitch of musical tone sounded from the sound system 22 corresponds to a pitch designated by the depressed key on the keyboard, since the reading out rate of the waveform data is determined by the frequency number FNO which corresponds to the pitch designated by the depressed key. Additionally, the digital tone signals are also outputted outside of the electronic music instrument EL through the digital output terminal DO, and the analogue tone signals are also outputted outside of the electronic musical instrument EL through the analogue output terminal AO.

During reading out the waveform data, the address signal value outputted from the accumulator 16*a* of tone signal producer 16 gradually increases. When the address signal value become equal to the end address value $END_2$ (see FIG. 13) memorized in the end point register 16*h*, the comparator 16*g* outputs an equal signal EQ. In this instance, the equal signal EQ is applied to the loop end control circuit 16*m* through the AND circuit 16*i*, since an end control data ENDC memorized in the end control register 16*h* is maintained to high level "1". The loop end control circuit 16*m* sets the address value memorized in the time division channel of accumulator 16*a* to the start address value STAD memorized in the start address register 16*f*. Thereafter, the accumulator 16a repeatedly designates from the start address STAD to the end address $ENDP_2$ of the memory region of the waveform memories 11, 12 corresponding to the selected tone color to repeatedly read out the waveform data corresponding to the selected tone color from the memories 11, 12. Thus, the sound system 22 continues to sound the musical tone having the selected tone color. In this instance, the interruption enable signal IRQE outputted from the timing signal generator 33 and interruption signal IRQ outputted from the tone signal producer 16 are maintained to low level "0".

Figure 6:
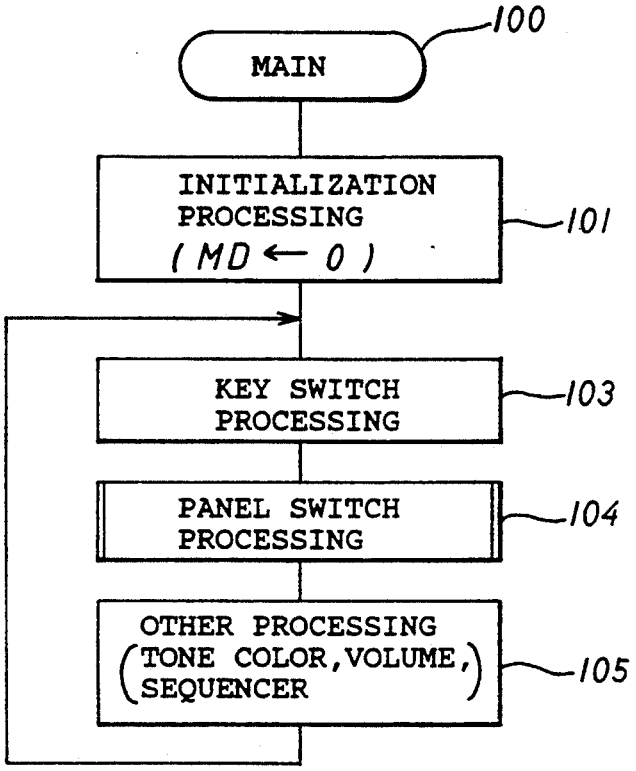
FIGS. 6 to 11 illustrate flow charts of programs executed by a microcomputer shown in FIG. 1.

When any one of depressed keys is released during sounding musical tones, the microcomputer 15 detects the key release to search the tone signal producing channel to which the released key was assigned at step 103 in FIG. 6. The microcomputer 15 also applies a channel signal indicative of the searched channel and a key-off signal indicative of key release to the tone signal producer 16. The tone signal producer 16 causes the tone signal to decay to finish the production of tone signal at the tone signal producing channel designated by the applied channel signal. Thus, the sound system 22 also finishes sounding the musical tone. Although in this embodiment all 16 tone signal producing channels produce tone signals having the same tone color, they may produce tone signals having different tone colors by setting different start and end addresses STAD, $ENDP_2$ every time division channels of the start address register 16f and the end point register 16h.

Hereinafter, the mode of operation, which records external sound such as sound of wind, sound of flowing water, sound of rain and sound of wave as long and continuous waveform data into the hard disk memory 42 of personal computer system PC, will be described. In this instance, a player should depress any one of the number designating switches 14b and the record switch 14a simultaneously to designate the file number for storing the long and continuous waveform data in the hard disk memory 42. Thereafter, the player should connect the magnetic tape recorder in which external sound described above is previously recorded at left and right channels for a long period of time to the analogue input terminal AI and should depress the start switch 14c. In this instance, a microphone, which receives an external sound, may be connected to the input terminal AI to directly input an external sound signal to the electronic musical instrument EL. If an external sound signal is converted to a digital signal, the digital signal should be applied to the digital input terminal DI.

Figure 7:
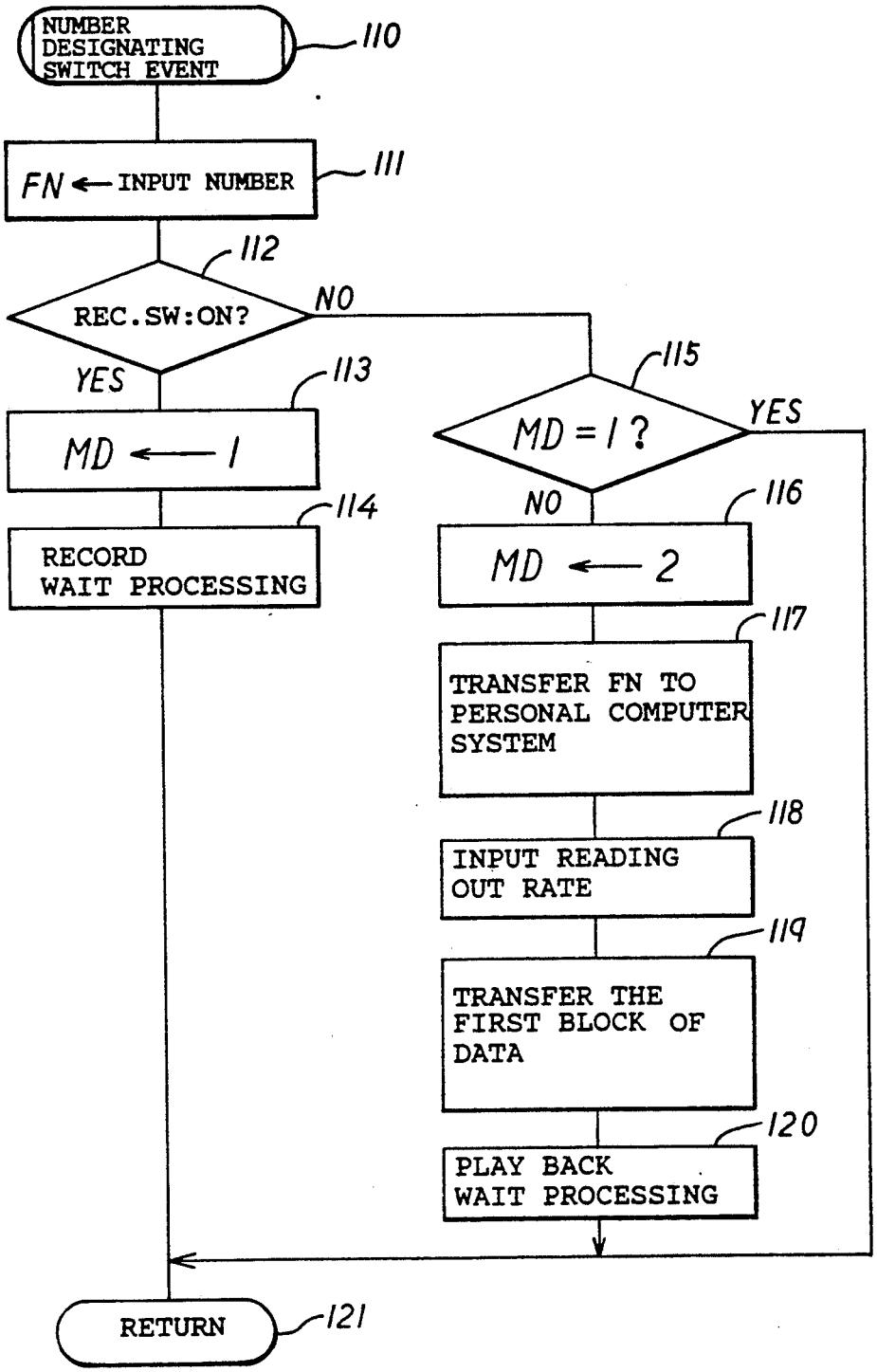

When any one of the number designating switches 14b is depressed as describe above, the microcomputer 15 detects the depression of switch at panel switch processing routine of step 104 in FIG. 6 to initiate execution of a number designating switch event routine at step 110 in FIG. 7. In this routine, the microcomputer 15 inputs data representing a depressed switch to set a file number FN to the data value. At the following step 112, the microcomputer 15 determines whether the record switch 14a is depressed or not. In this instance, the record switch 13a is depress as described above, therefore the microcomputer 15 determines a "YES" answer to cause the program to proceed to step 113. The microcomputer 15 sets the mode flag MD to "1" at step 113, executes record wait processing routine at step 114, and finishes execution of the number designating switch event routine. During executing the record wait processing routine, the microcomputer 15 transfers the file number FN to the microcomputer 41 and instructs the microcomputer 41 to prepare for recording a external sound signal. The microcomputer 41 writes the file number FN into the hard disk memory 42 through the interface circuit 43, and thereafter inputs the long and continuous waveform data representing an external sound signal from the mixing circuit 32 for a long period of time to prepare for writing it into the hard disk memory 42 through the interface circuit 43.

Figure 8:
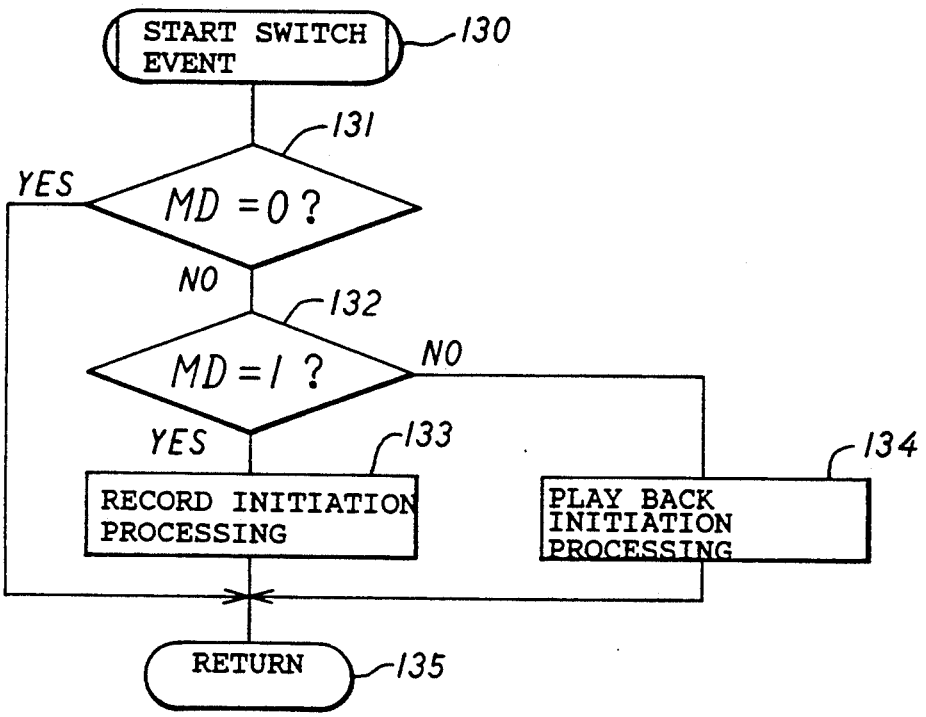

When the start switch 14c is depressed as describe above, the microcomputer 15 detects the depression of start switch 14b at panel switch processing routine of step 104 in FIG. 6 to initiate execution of a start switch event routine at step 130 in FIG. 8. In this routine, the microcomputer 15 respectively determines at step 131, 132 "NO" and "YES" answers on the basis of the mode flag MD maintained to "1" to cause the program to proceed to step 133. The microcomputer 15 instructs the microcomputer 41 to initiate recording the long and continuous waveform data at step 133, and thereafter finishes execution of the start switch event routine at step 135. The microcomputer 41 applies the control signal for initiating record operation of the long and continuous waveform data and the clock signal $\phi_{RD}$ to the mixing circuit 32 and the interface circuit 43. The mixing circuit 32 applies the long and continuous waveform data for the left and right channels applied from the analogue input terminal AI through the A/D converter 31 or the long and continuous waveform data applied from the digital input terminal DI to the microcomputer 41 synchronously with the clock signal $\phi_{RD}$. The microcomputer 41 writes the long and continuous waveform data for the left and right channel into a memory region of hard disk memory 42 designated by the file number FN synchronously with the clock signal $\phi_{RD}$. In this instance, one sampling data (one word data) of the long and continuous waveform data applied from the A/D converter 31 or the digital input terminal DI is composed of upper and lower 8 bit data.

Figure 9:
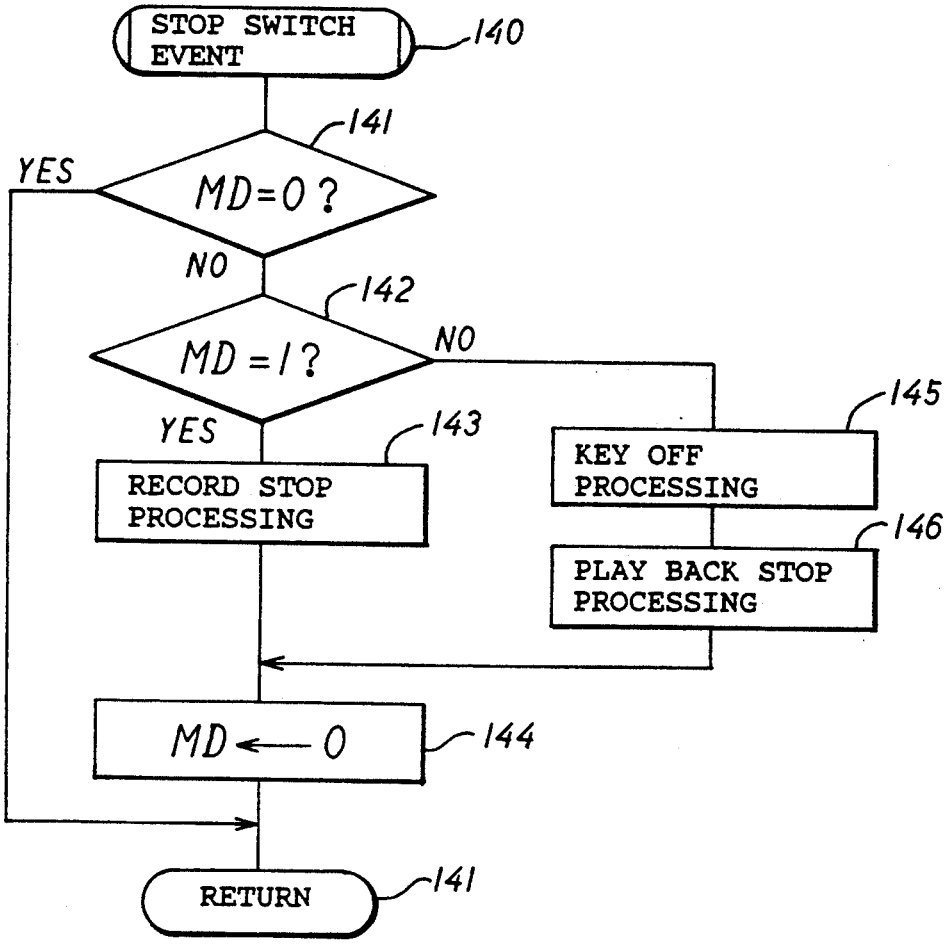

When the stop switch 14d is depressed during recording the long and continuous waveform data, the microcomputer 15 detects the depression of stop switch 14d at panel switch processing routine of step 104 in FIG. 6 to initiate execution of a stop switch event routine at step 140 in FIG. 9. In this routine, the microcomputer 15 respectively determines at step 141, 142 "NO" and "YES" answers on the basis of the mode flag MD maintained to "1" to causes the program to proceed to step 143. The microcomputer 15 instructs the microcomputer 41 to stop recording the long and continuous waveform data at step 143. After processing of step 143, the microcomputer 15 changes the mode flag MD into "0" at step 144, and finishes execution of the stop switch event routine at step 147. The microcomputer 41 applies the control signal to the mixing circuit 32 and the interface circuit 43 for stopping record operation of the long and continuous waveform data, and applies end data END representing the end point of long and continuous waveform data to the hard disk memory 42 through interface circuit 43. Thus, the hard disk memory 42 stops recording the long and continuous waveform data and records the end data END behind the bottom of long and continuous waveform data. In case a player hopes to record a different kind of long and continuous waveform data in the hard disk memory 42, he should designate a different file number FN by depressing a different one of number designating switches 14b to write the different long and continuous waveform data in a different memory region of the hard disk memory 42. In this way, various kinds of long and continuous waveform data or external sound signals are recorded in the hard disk memory 42.

Hereinafter, the mode of operation, which plays back an external sound signal recorded in the hard disk memory 42, will be described. In this instance, a player should depress any one of the number designating switches **14*b* without depressing the record switch 14*a* to designate a file number indicative of a memory region in which a kind of long and continuous waveform data is stored. Thereafter, the player should depress the start switch 14*c*. In response to depression of any one of the number designating switches 14*b*, the microcomputer 15 detects the depression of switch at panel switch processing routine of step 104 in FIG. 6 to initiate execution of the number designating switch event routine at step 110 in FIG. 7. In this routine, the microcomputer 15 inputs data representing a depressed switch to set a file number FN to the data value. At the following step 112, the microcomputer 15 determines a "NO" answer to cause the program to proceed to step 115, since the record switch 14*a* is not depressed. At step 115, the microcomputer 15 determines whether the mode flag MD is "1" or not. In this instance, the microcomputer 15 determines a "NO" answer at step 115 to cause the program to step 116–120, since the mode flag MD is maintained to "0". Accordingly, the processing of step 116–120 is not executed even if any one of number designating switches 14*b*** is depressed by mistake during the mode of operation recording the long and continuous waveform data.

The microcomputer 15 sets the mode flag MD to "2" at step 116, and transfers the file number FN set by processing of step 111 to the microcomputer 41 for designating the long and continuous waveform data to be read out at step 117. The microcomputer 41 applies the file number FN to the interface circuit 43 to prepare for reading out the long and continuous waveform data designated by the file number NF. After processing of step 117, the microcomputer 15 inputs the reading out value set by volume **14*e* to set a reading out rate to the value, the reading out value determines play back speed of external sound. At the following step 119, the microcomputer 15 instructs the microcomputer 41 to read out first and second halves $A_0$, $B_0$ of the first block of data of the long and continuous waveform data representing the first portion of long and continuous waveform signal for a left channel from a memory region of the hard disk memory 42, the memory region is designated by the file number FN. The microcomputer 41 applies the clock signal $\phi_{RD}$ to the interface circuit 43, the mixing circuit 32 and the address generator 27, and also controls the interface circuit 43 to read out the first and second halves $A_0$, $B_0$ of the first block of data. Thus, the first half $A_0$ and the second half $B_0$ of the first block of data of the long and continuous waveform data are applied from the hard disk memory 42 to the buffer memory 23 through the interface circuit 43 synchronously with the clock signal $\phi_{RD}$. At step 119, the microcomputer 15 also controls the counter 27*c* of address generator 27 through a control line (not shown) to cause the counter 27*c* to count up from the start address value STAD in order to designate the addresses of the left channel region of buffer memory 23 synchronously with the clock signal $\phi_{RD}$ at the same time as reading out the data $A_0$, $B_0$. Thus, the read out data $A_0$, $B_0$ are written in the left channel region of buffer memory 23. And, the microcomputer 15 also controls the microcomputer 41 and the counter 27*d* of address generator 27 to transfer the first and second halves $A_0$, $B_0$ of the first block of long and continuous waveform data representing a first portion of the long and continuous waveform signal for the right channel from a memory region of the hard disk memory 42 to the buffer memory 23** in the same manner described above.

After transferring the data $A_0$, $B_0$ for the left and right channels from the hard disk memory 42 to the buffer memory 23, the microcomputer 15 controls the counter **27*a* of address generator 27 through a control line (not shown) to count up from the start address value STAD to the middle address value $ENDP_1$ synchronously with the system clock signal $\phi$ for reading out the first half $A_0$ of the first block of data for the left channel from the buffer memory 23, and controls the counter 28*a* of address generator 28 through a control line (not shown) to count up from the start address value STAD to the middle address value $ENDP_1$ synchronously with the clock signal $\phi/2$ for writing the read out data $A_0$ in the first half of a left channel region of the waveform memory 12, the left channel region L is given for storing the first block of data $A_0$, $B_0$ of long and continuous waveform data for the left channel L as shown in FIG. 3. The microcomputer 15 controls the timing signal generator 33 to generate the select signal SEL representing high level "1" and the latch signals $L_0$, $L_1$, $L_2$ synchronized with the system clock signal $\phi$ (see FIG. 12). Thus, the first half $A_0$ of the first block of data of long and continuous waveform data stored in the buffer memory 23 is applied to the waveform memory 12 through the latch circuits 24, 25 and the gate circuit 26 and is written in the waveform memory 12. In this instance, the data $A_0$ in the form of 8 bits are converted into the data $A_0$ in the form of 16 bits by the latch circuits 24, 25, and the data $A_0$ in the form of 16 bits are written in the waveform memory 12 synchronously with the clock signal $\phi/2$. Additionally, the microcomputer 15 also controls the counter 27*b* of address generator 27 and the counter 28*b* of the address generator 28 to transfer the first half $A_0$ of the first block of data of long and continuous waveform data for the right channel from the buffer memory 23 to the waveform memory 12** in the same manner as described above.

After processing of step 119, the microcomputer 15 executes a play back wait processing routine at step 120, and finishes execution of the number designating switch event routine at step 121. In this play back wait processing routine, the microcomputer 15 controls the tone signal producer 16 to stop producing usual tone signals at the first through the fourth time division tone signal producing channels if usual tone signals are produced at these channels, since these channels are used for transferring and playing back the long and continuous waveform data. The microcomputer 15 also instructs the microcomputer 41 to prepare reading out the following portion of long and continuous waveform data designated by the file number FN, sets the count value of the counter **27*c*, 27 of address generator 27 to the start address value STAD, and sets the count value of the counter 28*a*, 28*b* of the address generator 28** to the middle address value $ENDP_1$.

When the start switch **14*c* is depressed as described above, the microcomputer 15 detects the depression of start switch 14*b* at panel switch processing routine of step 104 in FIG. 6 to initiate execution of a start switch event routine at step 130 in FIG. 8. In the routine, the microcomputer 15 determines at both steps 131, 132 "NO" answers on the basis of the mode flag MD maintained to "2" to cause the program to proceed to step 134. The microcomputer 15 executes a play back initiation processing routine at step 134, and thereafter finishes execution of the start switch event routine at step 135. In the play back initiation processing routine, the microcomputer 15 respectively assigns the production of tone signals based on the long and continuous waveform data for left and right channels to the first and second time division tone signal producing channels, and applies channel signals indicative of the assigned channels, a frequency number FNO corresponding to the reading out rate determined by processing of step 118 in FIG. 7, the end control signal ENDC indicative of low level "0" and key on signals to the tone signal producer 16. The microcomputer 15 also applies start and middle address values STAD, $ENDP_1$ indicative of start and middle addresses of left and right channel regions L, R of the waveform memory 12 to the accumulator 16***a* of tone signal producer 16, in the memory region the long and continuous waveform data for left and right channels are stored. The accumulator 16*a* counts up from the start address values STAD with rate corresponding to the applied frequency number FNO at the first and second time division channels to designate the addresses of the left and right channel regions L, R of waveform memory 12 for reading out a part of the long and continuous waveform data stored therein. Thus, the tone signal producer 16 initiates reading the first half $A_0$ of the first blocks of data of the long and continuous waveform data for left and right channels from the waveform memory 12 to produce tone signals or long and continuous waveform signals.

Figure 12:
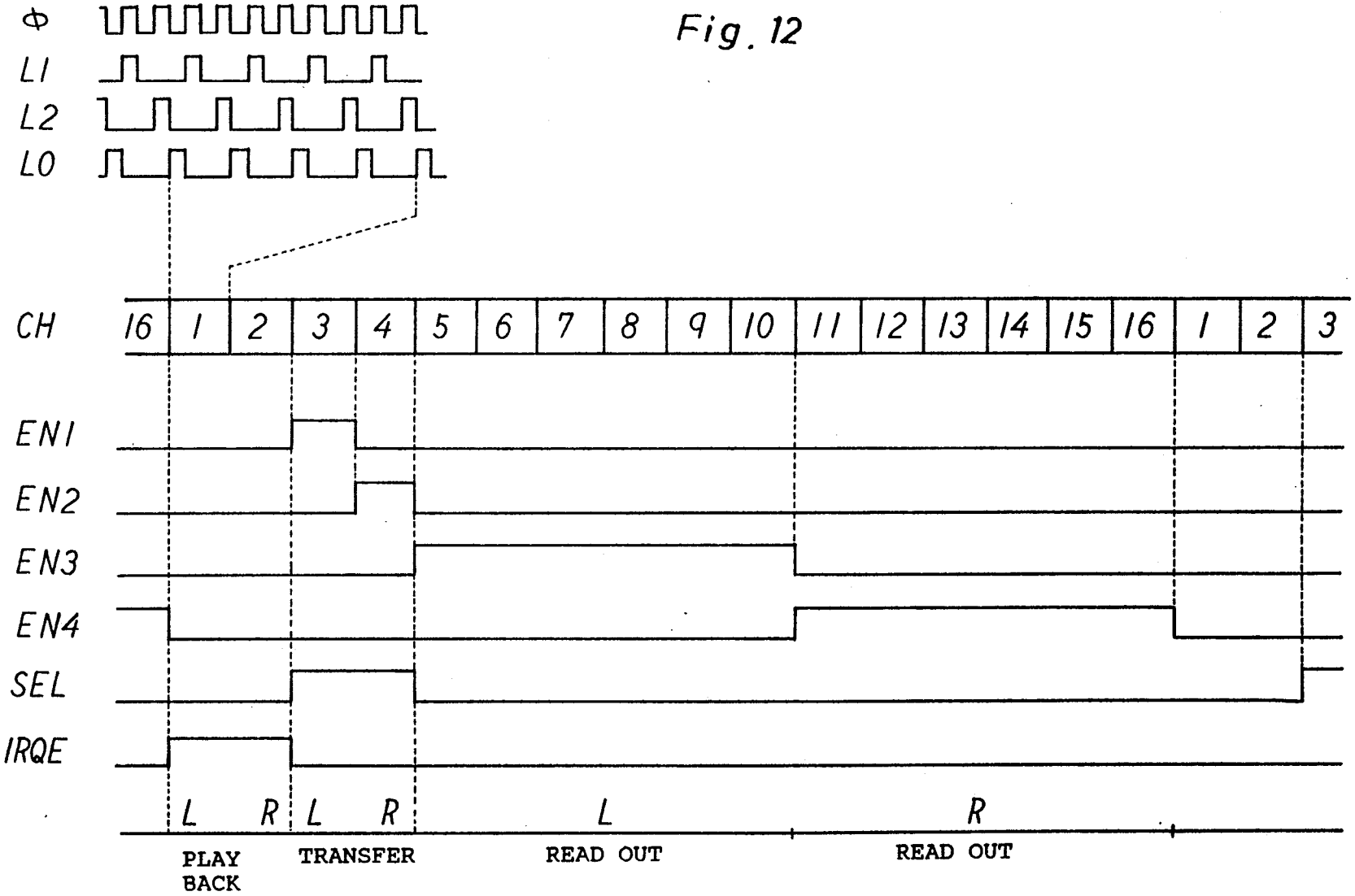
FIG. 12 is a time chart for illustrating operation of circuits shown in FIG. 1.
Figure 13:
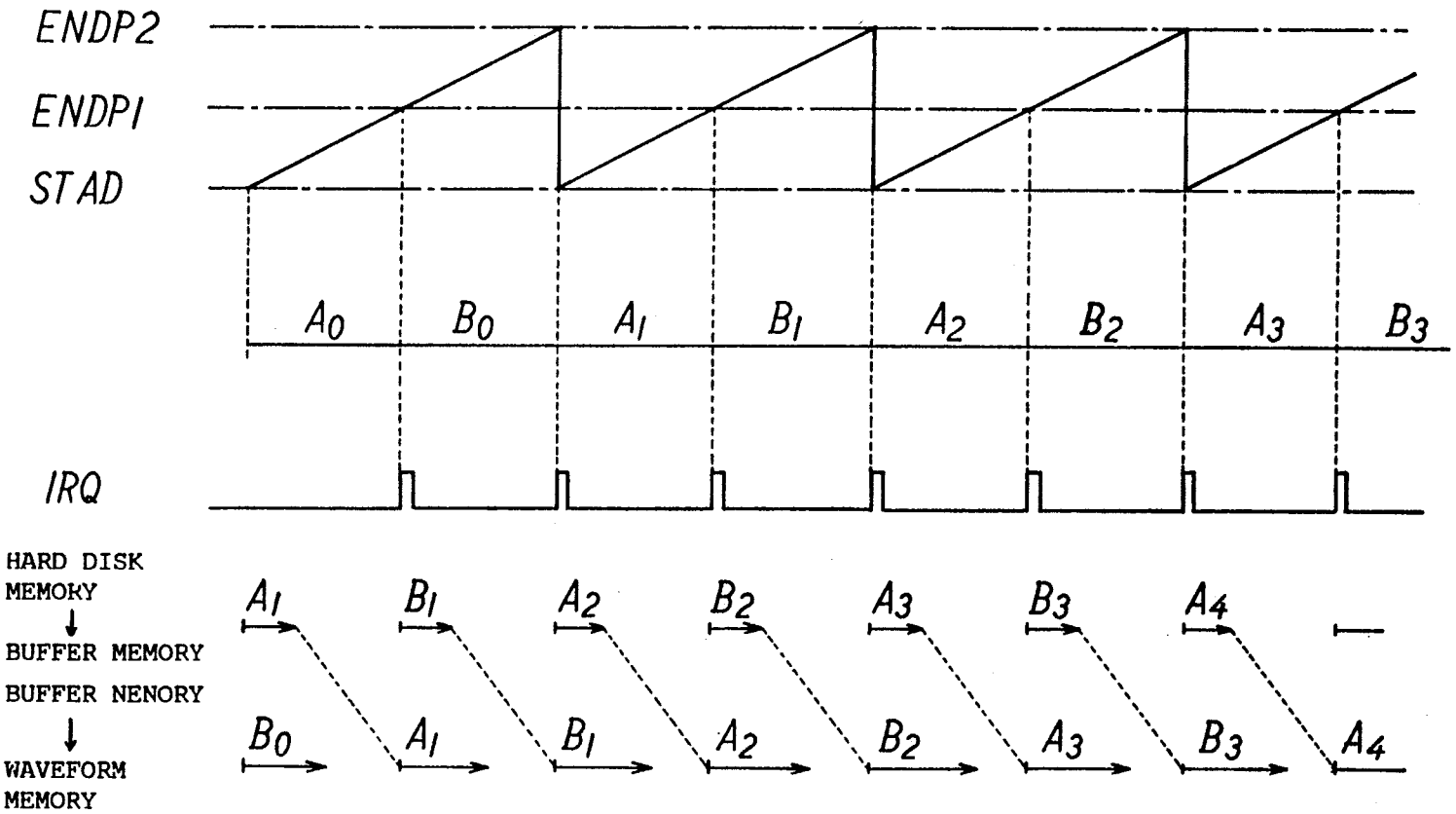
FIG. 13 is a time chart for illustrating read/write and transfer timing of continuous waveform data.

In the play back initiation routine, the microcomputer 15 also instructs the timing signal generator 33 to generate latch signals $L_0$, $L_1$, $L_2$, enable signals EN1–EN4, a select signal SEL and an interruption enable signal IRQE as shown in FIG. 12. The counter 27*a* of address generator 27 and the counter 28*a* of address generator 28 are enabled to count up at the third time division channel at which the enable signal EN1 are high level "1", and the counter 27*b* of address generator 27 and the counter 28*b* of address generator 28 are enabled to count up at the fourth time division channel at which the enable signals EN2 is high level "1". In this instance, the count values of counters 27*a*, 27*b*, 28*a*, 28*b* are set as the middle address value at first by execution of the play back wait processing routine of step 120. Thus, the counters 27*a*, 27*b* count up from the middle address value synchronously with the system clock signal $\phi$ to respectively designate the addresses of left and right channel regions L, R of the buffer memory 23 for reading out the waveform data therefrom, the memory regions respectively store the second half $B_0$ of a first block of data of the long and continuous waveform data for left and right channels. The counters 28*a*, 28*b* count up from the middle address value synchronously with the clock signal $\phi/2$ to respectively designate the addresses of left and right channel regions L, R of the waveform memory 12 for writing the waveform data therein, the left and right channel regions L, R respectively store the second half $B_0$ of the first block of data of the long and continuous waveform data for left and right channels. The counted value by the counters 28*a*, 28*b* is applied to the waveform memory 12 through the selector 22, since the select signal SEL is high level "1" at the third and fourth time division channels. As a result, the second half $B_0$ of the first block of data for left and right channels stored in the buffer memory 23 in the form of 8 bits is converted to the waveform data in the form of 16 bits by operation of the latch circuits 24, 25 to be written in the left and right channel regions L, R of the waveform memory 12, the second half $B_0$ follows the first half $A_0$ of the first block of data.

In the play back initiation routine, the microcomputer 15 also instructs the microcomputer 41 to initiate reading out a first half $A_1$ of the second block of data of the long and continuous waveform data following the first block of data $A_0$, $B_0$ from the hard disk memory 42. The microcomputer 41 reads out the first half $A_1$ of the second block of data for left and right channels from the hard disk memory 12 through the interface circuit 43 to respectively apply them to the buffer memory 23 synchronously with the clock signal $\phi_{RD}$ under a condition where enable signals EN3, EN4 are respectively high level "1". In this instance, the count values of the counter 27*c*, 27*d* of address generator 27 is maintained to the start address value STAD by execution of the play back wait processing routine of step 120 in FIG. 7 at first, and are respectively enabled to count up from the start address values STAD to designate the address of the left and right channel regions L, R of buffer memory 23 for writing the data therein synchronously with the clock signal $\phi_{RD}$ when the enable signals EN3, EN4 are respectively high level "1". Thus, the first half $A_1$ of the second block of data for the left and right channels are respectively written in the first half of left and right channel regions of the buffer memory 23 from the hard disk memory 12.

During the counters 27*a*–27*d*, 28*a*, 28*b* are counting, the count values of the counters 28*a*, 28*b* respectively reach the middle address value $ENDP_1$. Thus, the end count value detection circuit 27*e* detects the count values respectively become equal to the middle address values $END_1$ to respectively generate stop signals SP3, SP4 under the condition where the enable signals EN3, EN4 are respectively high level "1". Thereafter, the count values of the counters 27*a*, 27*b*, 28*a*, 28*b* reach the end address value $ENDP_2$. Thus, the end count value detection circuit 27*e* detects the count values respectively become equal to the end address value $ENDP_2$ to respectively generate stop signals SP1, SP2 under the condition where the enable signals EN1, EN2 are high level "1". As a result, the counters 27*a*–27*d*, 28*a*, 28*b* stop counting to halt transferring the first half $A_1$ of the second block of data from the hard disk memory 42 to the buffer memory 23 and to halt transferring the second half $B_0$ of the first block of data from the buffer memory 23 to the waveform memory 12. Additionally, the stop signals SP3, SP4 are also applied to the microcomputer 41 to halt reading out the waveform data from the hard disk memory 42 through the interface circuit 43. On the other hand, the tone signal producer 16 continues to read out the first half $A_0$ of the first block of data from the waveform memory 12 in order to produce tone signals based on the first half $A_0$ of the first block of data (see FIG. 13).

When the tone signal producer 16 finishes reading out the first half $A_0$ of the first block of data from the waveform memory 12, the comparator 16*g* generates an equal signals EQ since the address signal value outputted from the accumulator 16*a* becomes equal to the middle point data value $ENDP_1$ stored in the end point register 16*h*. In this instance, the AND circuit 16*i* maintains its output signal to low level "0", since the end control signal ENDC stored in the end control register 16*k* represents low level "0". Thus, the accumulator 16*a* continues to count up to designate the address of waveform memory 12. On the other hand, the AND circuit 16*j* applies a signal representing high level "1" to the set input terminal S of flipflop circuit 16*n* at the first and second time division channels used for playing back the long and continuous waveform signals, since the interruption enable signal IRQE applied from the timing signal generator 33 is high level "1" at the channels (see FIG. 12). Thus, the flipflop circuit 16*n* is changed into the set state to apply an interruption signal IRQ indicative of high level "1" to the microcomputer 41. The microcomputer 41 returns an interruption clear signal IRQC to the reset terminal R of flipflop circuit 16*n* of the tone signal producer 16 through the microcomputer 15 after the microcomputer 15 confirmed receiving the interruption signal IRQ. Thus, the flipflop circuit 16*n* is changed into a reset state to change the interruption signal IRQ from high level "1" to low level "0".

Figure 10:
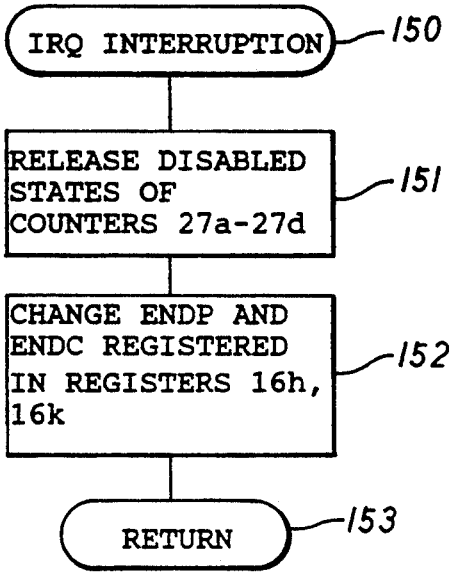
Figure 11:
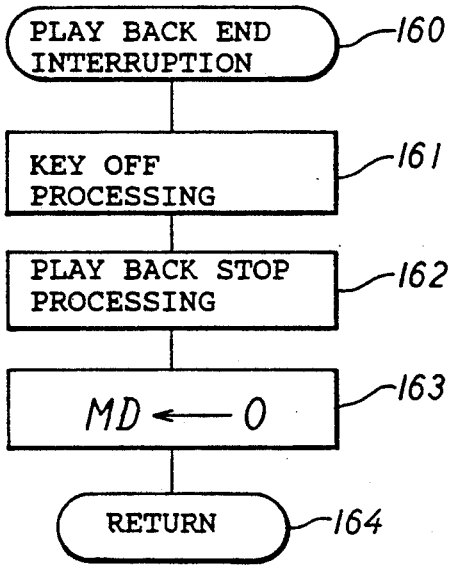

In response to the interruption signal IRQ indicative of high level "1", the microcomputer 15 initiates an IRQ interruption program at step 150 in FIG. 10. At step 151 of the IRQ interruption program, the microcomputer 15 applies the interruption signal IRQ to the end count value detection circuit 27*e* of address generator 27. Thus, the stop signals SP1–SP4 become low level "0" to release disabled states of the counters 27*a*–27*d*. At the following step 152, the microcomputer 15 respectively registers the end address values $ENDP_2$ representing the end addresses of the left and right channel regions L, R of the waveform memory 12 in the first and second time division channels of the end point register 16*h*. The microcomputer 15 also registers the end control signal ENDC indicative of high level "1" in the first and second time division channels of the end control register 16*k* at step 152. After processing of step 152, the microcomputer 15 finishes execution of the IRQ interruption program at step 153. After execution of the IRQ interruption program, the accumulator 16*a* continue to count up to designate the addresses of the second half of the left and right channel regions L, R of the waveform memory 12 in the same manner describe above, in the left and right channel regions L, R the second half $B_0$ of the first block of data of long and continuous waveform data for the left and right channels are already written from the hard disk memory 42 through the buffer memory 23. Thus, the tone signal producer 16 continues to read out the second half $B_0$ of the first block of data from the waveform memory 12 to produce tone signals based on the data $B_0$ for the left and right channels.

During reading out the second half $B_0$ of the first block of data from the waveform memory 12, the counters 27*a*–27*d* of address generator 27 and the counters 28*a*, 28*b* of address generator 28 initiates counting up in response to the arrival of enable signals EN1–EN4. In this instance, the count values of the counters 27*a*, 27*b*, 28*a*, 28*b* have been maintained to start address values STAD since stop signals SP1, SP2 were generated. Thus, the counters 27*a*, 27*b*, 28*a*, 28*b* respectively count up from the start address values STAD to respectively designate the addresses of first half of left and right channel regions L, R of the buffer memory 23 and the waveform memory 12. As a result, the first half $A_1$ of the second block of data for left and right channels stored in the buffer memory 23 are transferred to the waveform memory 12.

The interruption signal IRQ is also applied to the microcomputer 41. The microcomputer 41 reads out the second half $B_1$ of the second block of data of the long and continuous waveform data for left and right channels from the hard disk memory 12 through the interface circuit 43 to apply them to the buffer memory 23 synchronously with the clock signal $\phi_{RD}$ under a condition where enable signals EN3, EN4 are respectively high level "1". In this instance, the count values of the counter 27*c*, 27*d* have been maintained to the middle address values $ENDP_1$ since the stop signals SP3, SP4 were generated. Thus, the counters 27*c*, 27*d* respectively count up from the middle address values $ENDP_1$ to write the read out second half $B_1$ of the second block of data in the second half of the left and right channel regions L, R of the buffer memory 23.

After hard disk memory 42 finishes transferring the second half $B_1$ of the second block of data to the buffer memory 23 and the buffer memory 23 finishes the first half $A_1$ of the second block of data to the waveform memory 12, the counters 27*a*–27*d* of address generator 27 and the counter 28*a*, 28*b* of address generator 28 stop counting up by the stop signals SP1–SP4 applied from the end count value detection circuit 27*e* in the same manner as described above. In this instance, the tone signal producer 16 continues to read out the second half $B_0$ of the first block of data to produce tone signals based on the data $B_0$.

When the tone signal producer 16 finishes reading out the data $B_0$, the comparator 16*g* detects the output signal value applied from the accumulator 16*a* and the end address value $ENDP_2$ registered in the end point register 16*h* are equal to applies a equal signal EQ to AND circuits 16*i*, 16*j*. The AND circuit 16*i* applies a signal indicative of high level "1" to the loop end control circuit 16*m*, since an end control signal ENDC applied from the end control register 16*k* is representing high level "1". The loop end control circuit 16*m* respectively controls the accumulator 16*a* to change address values memorized at its first and second time division channels to the start address values STAD which is memorized in the start address register 16*f*. The accumulator 16*a* initiates counting up from the start address values STAD again to designate addresses of left and right channel regions of the waveform memory 12 with the rate corresponding to the frequency number FNO. Thus, the tone signal producer 16 initiates reading out the first half $A_1$ of the second block of data of the long and continuous waveform data from the waveform memory 12, the data $A_1$ is already transferred from the buffer memory 23 to the waveform memory 12. The AND circuit 16*j* also applies a signal indicative of high level "1" to the set input terminal S of flipflop circuit 16*n*, since the interruption enable signal IRQE applied thereto is representing high level "1". Thus, the flipflop circuit 16*n* outputs interruption signal IRQ indicative of high level "1" for a short time by cooperation with the microcomputer 41 to control transferring the second half $B_1$ of the second block of data following the data $A_1$ from the buffer memory 23 to waveform memory 12 and to control transferring the first half $A_2$ of the third block of data following the data $B_1$ from the hard disk memory 42 to the buffer memory 23.

Thereafter, while the tone signal producer 16 is reading out the first half $A_1$, $A_2$, $A_3$ . . . of each block of data of the long and continuous waveform data from the first half of left and right channel regions L, R of the buffer memory 23 to produce tone signals based on the read out data $A_1$, $A_2$, $A_3$ . . . , the waveform memory 12 transfers the second half $B_1$, $B_2$, $B_3$ . . . of each block of data from its second half of left and right channel regions L, R to the second half of left and right channel regions L, R of the waveform memory 12, and the hard disk memory 42 transfers the first half $A_2$, $A_3$, $A_4$ . . . of each block of data to the first half of left and right channel regions L, R of the buffer memory 23, in the same manner as described above. During the tone signal producer 16 is reading out the second half $B_1$, $B_2$, $B_3$ . . . of each block of data of the long and continuous waveform data from the second half of left and right channel regions L, R of the waveform memory 12 to produce tone signals based on the data $B_1$, $B_2$, $B_3$ . . . , the buffer memory 23 transfers the first half $A_1$, $A_2$, $A_3$ . . . of each block of data data from its first half of left and right channel regions L, R to the first half of left and right channel regions L, R of the waveform memory 12, and the hard disk memory 42 transfers the second half $B_2$, $B_3$, $B_4$ . . . of each block of data to the second half of the left and right channel regions L, R of the buffer memory 23. Thus, the tone signal producer 16 repeatedly and sequentially reads out the waveform data from the waveform memory 12 to produce digital tone signals based on the read out waveform data for a long time. As described heretofore, the present invention can offer the electronic musical instrument system which produces long and continuous waveform signals for a long period of time by improving a conventional electronic musical instrument. Because, above-mentioned electronic musical instrument system is simply added with hard disk memory 42 for storing the long and continuous waveform data and the control circuit for transferring the long and continuous waveform data from the hard disk memory 42 to the waveform memory 12 of the electronic musical instrument EL for a long period of time.

The tone signal producer 16 also controls the volume level of the above-mentioned long and continuous digital tone signals, and thereafter applies the digital tone signals to the sound system 22 through the D/A converter 21. The sound system 22 sounds musical tones corresponding to digital tone signals. In this instance, the first through the fourth tone signal producing channels of tone signal producer 16 are used for producing long and continuous waveform signal for a long period of time, and the fifth through the sixteenth tone signal producing channels can be used for producing usual tone signals in response to key depression or note designation. As a result, a player uses the long and continuous waveform signal for a long period of time as a background sound during playing a keyboard. Additionally, a waveform data transfer from the hard disk memory 42 to the buffer memory 23 and a waveform data transfer from the buffer memory 23 to the waveform memory 12 are mainly controlled by additional circuits to the conventional electronic musical instrument such as address generators 27, 28 and microcomputer 41, and the microcomputer 15 is not much engaged in reading out the long and continuous waveform data while the tone signal producer 16 is producing usual tone signals. Thus, the response character of tone signal producing to key depression does not become slow in comparison with the case of usual playing (in case mode flag MD is maintained to "1"), even if the electronic musical instrument EL produces long and continuous waveform signals together with usual tone signals.

When the stop switch **14*d* is depressed during producing the long and continuous waveform signal, the microcomputer 15 detects the depression of stop switch 14*d* at panel switch processing routine of step 104 in FIG. 6 to initiates execution of a stop switch event routine at step 140 in FIG. 9. In this routine, the microcomputer 15 determines at both steps 141, 142 "NO" answers on the basis of mode flag MD maintained to "2" to causes the program to proceed to step 145. At step 145, the microcomputer 15 applies channel signals representing the first and second tone signal producing channels and key off signals for stopping the production of tone signals to the tone signal producer 16. The tone signal producer 16 causes tone signals to decay to finish production of the tone signals at the first and second tone signal producing channels. At the following step 145, the microcomputer 15 executes play back stop processing routine. In this play back stop processing routine, the microcomputer 15 releases inhibit of key assignment to the first through the fourth tone signal producing channels which have been used for producing long and continuous waveform signals. Thus, hereafter, if any one of keys is depressed newly, the depressed key can be also assigned to any one of the first through the forth tone signal producing channels. In the play back routine, the microcomputer 15 also applies a control signal representing stop of play back operation to the timing generator 33 and the microcomputer 41. The timing generator 33 stops generating signals EN1--EN4, SEL, L0-L2, IRQE except the system clock signal $\phi$. The microcomputer 41 stops reading out the long and continuous waveform data from the hard disk memory 42. After processing of step 146, the microcomputer 15 changes the mode flag into "0" at step 144**, and thereafter finishes execution of the stop switch even routine.

On the other hand, the microcomputer 41 may have read out all the long and continuous waveform data from the hard disk memory 42 before the stop switch **14*d* is depressed. In this instance, the microcomputer 41 detects the end data END read out from the hard disk memory 42 to applies a play back end interruption signal to the microcomputer 15. In response to the interruption signal, the microcomputer 15 initiates execution of play back end interruption program. The play back end interruption program is composed of steps 160-164 shown in FIG. 11 which are same processing as above-mentioned step 144-145 in FIG. 9**. Thus, the production of long and continuous waveform signals ends as described above.

Although in the above description of operation only the case of writing long and continuous waveform data in a region of waveform memory 12 is described, short waveform data may be written in the region of waveform memory 12 from outside. A waveform data formed in the electronic musical instrument EL may be written in the region of waveform memory 12.

Although in the foregoing embodiment the tone signal producer 16 repeatedly and sequentially designates the start address STAD through the end address $ENDP_2$ of a region of the waveform memories 11, 12 to read out a waveform data stored therein for producing a tone signal, the tone signal producer 16 may read out a waveform data corresponding to an attack portion of a musical tone at first and thereafter repeatedly and sequentially reads out the waveform data corresponding to a sustain portion of the musical tone from a region of the memories 11, 12 in order to produce a tone signal, in this region the waveform data respectively corresponding to the attack and sustain portion are separately stored.

Although in the forgoing embodiment, a play back operation of a long and continuous waveform signal is initiated by depression of the start switch 14c, the play back operation may be initiated by depressing any one of keys. Additionally, the present invention can be applied to an electronic musical instrument having an auto-player or a musical sequencer which includes a memory of large capacity for storing a sequence of key operation data or note designation data, and a play back operation of a long and continuous waveform signal may be automatically controlled to initiate by the auto-player. In this instance, control data, which instructs playing back a long and continuous waveform data, is stored among the sequence of key operation data. During reading out the key operation data to produce tone signals based on the read out key operation data by processing of step 105 in FIG. 6, the control data is read out to initiate a play back operation of a long and continuous waveform signal instead of the above-mentioned start switch 14c.

Although in the foregoing embodiment sounds of wind, flowing water, rain and wave on beach are adapted as a long and continuous waveform signal, other natural sounds and electrically synthesized sounds may be also adapted as a long and continuous waveform signal.

What is claimed is:

1. A tone signal generator utilizing ancillary memories for an electronic musical instrument system comprising:

a source memory for storing a continuous waveform data to be applied to said electronic musical instrument system;

a set of ancillary memories each capacity of which is smaller than that of said source memory;

writing means for writing the continuous waveform data from said source memory alternately and sequentially into said ancillary memories at a predetermined time interval so that different portions of the continuous waveform data are sequentially stored in respective ancillary memories;

reading means for alternately and sequentially reading out the waveform data from said ancillary memories; and control means for controlling said reading means in such a manner that the waveform data is read out from the ancillary memories at a lower rate than the writing rate of the waveform data.

2. A tone signal generator utilizing ancillary memories for an electronic musical instrument system as claimed in claim 1, wherein said control means includes means for adjusting reading rate independently defined from said writing rate.

3. A tone signal generator utilizing ancillary memories for an electronic musical instrument system as claimed in claim 1, wherein said source memory is a hard disk memory.

4. a tone signal generator utilizing ancillary memories for an electronic musical instrument system as claimed in claim 1, wherein said ancillary memories are two regions formed in a random access memory.

5. A tone signal generator utilizing ancillary memories for an electronic musical instrument system as claimed in claim 1, wherein said writing means and said reading means have address designation means respectively for independently designating addresses of said ancillary memories.

6. A tone signal generator utilizing ancillary memories for an electronic musical instrument system as claimed in claim 1 further comprising record means for recording a continuous waveform data in said source memory.

7. A tone signal generator for an electronic musical instrument system having note designation means for designating one of plural notes to produce a note data indicative of the designated note, a plurality of tone channels to be applied with the note data for producing a tone signal corresponding to the applied note data, and assignment means for assigning the note data to one of said tone channels, the tone signal generator comprising:

a source memory for storing a continuous waveform data to be applied to said tone channels; and a mode selector for selectively setting a first mode of a second mode;

wherein said assignment means includes means responsive to a first signal indicative of the first mode from said mode selector for permitting assignment of the continuous waveform data to at least one of said tone channels for producing a tone signal of the continuous waveform data therefrom and also permitting the assignment of the note data to the remaining tone channels, and responsive to a second signal indicative of the second mode from said mode selector for permitting only the assignment of the note data to said tone channels.

8. A tone signal generator utilizing ancillary memories for an electronic musical instrument system as claimed in claim 7, wherein said source memory is a hard disk memory.

9. A tone signal generator utilizing ancillary memories for an electronic musical instrument system as claimed in claim 7 further comprises record means for recording a continuous waveform data in said source memory.

10. A tone signal generator utilizing ancillary memories for an electronic musical instrument system comprising:

a source memory for storing waveform data representing a time-variant continuous-waveform, said waveform data being composed of plural data portions;

a set of ancillary memories each having a capacity which is smaller than that of said source memory;

writing means for sequentially writing at a writing rate each respective data portion from said source memory into an available one of said ancillary memories at a predetermined time interval, said available one sequentially alternating among said ancillary memories; and reading means for reading out at a reading rate a previously-written data portion from one of said ancillary memories other than said available one, said reading rate being lower than said writing rate so that the continuous-waveform may be generated as a tone signal.

11. A tone signal generator utilizing ancillary memories for an electronic musical instrument system as claimed in claim 10 further comprising adjusting means for adjusting said reading rate independently of said writing rate.

12. A tone signal generator utilizing ancillary memories for an electronic musical instrument system as claimed in claim 10, wherein said source memory is a hard disk memory.

13. A tone signal generator utilizing ancillary memories for an electronic musical instrument system as claimed in claim 10, wherein said ancillary memories are composed of two random access memory areas.

14. A tone signal generator utilizing ancillary memories for an electronic musical instrument system as claimed in claim 10, wherein said writing means and said reading means address said ancillary memories independently.

15. A tone signal generator utilizing ancillary memories for an electronic musical instrument system as claimed in claim 10 further comprising record means for recording said waveform data in said source memory.

16. A tone signal generator utilizing ancillary memories for an electronic musical instrument system comprising:

note designation means for designating one of plural notes to produce note data indicative of the designated note;

a plurality of tone channels each producing a tone signal corresponding to data assigned thereto;

a source memory for storing first waveform data representing a time-variant continuous-waveform;

a plurality of ancillary memories for temporarily storing the first waveform data from the source memory and second waveform data corresponding to note data;

a mode selector for selectively setting the first mode or a second mode; and assignment means responsive to the selected first mode for assigning said first waveform data from the ancillary memories to a specified one of said tone channels and assigning the second waveform data corresponding to said note data from the ancillary memories to an available one of the tone channels other than said specified channel, and responsive to the selected second mode for assigning the second waveform data from the ancillary memories to an available one of said tone channels, so that said plurality of tone production channels can produce both a tone signal corresponding to said first waveform data and a tone signal corresponding to said second waveform data when in the first mode and can produce a tone signal corresponding to said second waveform but not the first waveform data when in the second mode.

17. A tone signal generator utilizing ancillary memories for an electronic musical instrument system as claimed in claim 16, wherein said source memory is a hard disk memory.

18. A tone signal generator utilizing ancillary memories for an electronic musical instrument system as claimed in claim 16 further comprises record means for recording said waveform data in said source memory.

19. A tone signal generator utilizing ancillary memories for an electronic musical instrument system comprising:

a source memory for storing waveform data representing a time-variant continuous waveform formed of plural contiguous data portions;

first and second ancillary memories each having a capacity which is smaller than that of the source memory;

writing means for writing contiguous data portions in sequence into the first and second ancillary memories in an alternating fashion at a writing rate; and reading means for reading the previously written contiguous data portions from the ancillary memories in an alternating fashion at a reading rate which is less than the writing rate, wherein while one data portion is being written into one memory a previously-written contiguous data portion is being read from the other memory, whereby the continuous waveform may be reproduced as a continuous tone signal.

* * * * *